US006200635B1

(12) United States Patent
Kwok

(10) Patent No.: US 6,200,635 B1
(45) Date of Patent: Mar. 13, 2001

(54) OMEGA SPRAY PATTERN AND METHOD THEREFOR

(75) Inventor: Kui-Chiu Kwok, Mundelein, IL (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 09/143,883

(22) Filed: Aug. 31, 1998

(51) Int. Cl.[7] ..... B05D 5/00

(52) U.S. Cl. ..... 427/286; 427/208.2; 427/208.6; 427/288; 239/11; 239/296; 118/506

(58) Field of Search ..... 239/11, 296; 427/207.1, 427/208.2, 208.4, 208.6, 286, 288; 118/506

(56) References Cited

U.S. PATENT DOCUMENTS

| | | |
|---|---|---|
| Re. 33,158 | 2/1990 | Stouffer et al. . |
| Re. 33,159 | 2/1990 | Bauer et al. . |
| Re. 33,448 | 11/1990 | Bauer . |
| Re. 33,481 | 12/1990 | Ziecker et al. . |
| Re. 33,605 | 6/1991 | Bauer . |
| 2,031,387 | 2/1936 | Schwarz . |
| 2,212,448 | 8/1940 | Modigliani . |
| 2,297,726 | 10/1942 | Stephanoff . |
| 2,628,386 | 2/1953 | Tornberg . |

(List continued on next page.)

FOREIGN PATENT DOCUMENTS

| | | |
|---|---|---|
| 197 15 740 | 10/1998 | (DE) . |
| -756907 | 9/1956 | (GB) . |
| 1392667 | 4/1975 | (GB) . |
| 44-16168 | 7/1969 | (JP) . |
| WO9207122 | 4/1992 | (WO) . |
| 9315895 | 8/1993 | (WO) . |

OTHER PUBLICATIONS

Rao et al., "Vibration and Stability in the Melt Blowing Process", 1993, 3100–3111.

Non–Wovens World magazine, Meltblown Technology Today, 1989, pp. 1–158.

The New Non–Wovens World, "Developments in Melt Blowing Technology", 1993, pp. 73–82.

McNally et al., J & M Laboratory, "Durafiber/Durastitch Adhesives Applicaitons Methods Featuring Solid State Application Technology", Sep. 8, 1997 at Inda–Tec 97 Meeting, Cambridge MA, pp. 26.1–8.

Gregory F. Ward, "Micro–Denier NonWoven Process and Fabrics", on or about Oct. 1997, pp. 1–9.

Nordson Corp., "Control Coat System", "Control Fiberization Gun", "Meltex", "EP Coating Heads", Metering Technology, Web pages, Apr. 23, 1998, 9 pgs.

*Primary Examiner*—Christopher Raimund
(74) *Attorney, Agent, or Firm*—Donald J. Breh; Mark W. Croll; John P. O'Brien

(57) ABSTRACT

A method for producing visco-elastic fluidic material flows by drawing a visco-elastic fluidic material with corresponding separate second fluid flows associated therewith to form a visco-elastic fiber vacillating in a repeating, generally omega-shaped pattern having a bowed portion with first and second side portions that first converge toward each other and then diverge outwardly in generally opposing directions. In one operation, the visco-elastic fiber vacillating in the repeating, generally omega-shaped pattern is an adhesive material deposited onto woven and non-woven fabric substrates and stretched elongated elastic strands in the manufacture of a variety of bodily fluid absorbing hygienic articles.

39 Claims, 2 Drawing Sheets

U.S. PATENT DOCUMENTS

| | | |
|---|---|---|
| 3,038,202 | 6/1962 | Harkenrider . |
| 3,176,345 | 4/1965 | Powell . |
| 3,178,770 | 4/1965 | Willis . |
| 3,192,562 | 7/1965 | Powell . |
| 3,192,563 | 7/1965 | Crompton . |
| 3,204,290 | 9/1965 | Crompton . |
| 3,213,170 | 10/1965 | Erdmenger et al. . |
| 3,253,301 | 5/1966 | McGlaughlin . |
| 3,334,792 | 8/1967 | De Vries et al. . |
| 3,380,128 | 4/1968 | Cremer et al. . |
| 3,488,806 | 1/1970 | De Cecco et al. . |
| 3,492,692 | 2/1970 | Soda et al. . |
| 3,501,805 | 3/1970 | Douglas, Jr. et al. . |
| 3,613,170 | 10/1971 | Soda et al. . |
| 3,650,866 | 3/1972 | Prentice . |
| 3,704,198 | 11/1972 | Prentice . |
| 3,755,527 | 8/1973 | Keller et al. . |
| 3,806,289 | 4/1974 | Schwarz . |
| 3,825,379 | 7/1974 | Lohkamp et al. . |
| 3,849,241 | 11/1974 | Butin et al. . |
| 3,861,850 | 1/1975 | Wallis . |
| 3,874,886 | 4/1975 | Levecque et al. . |
| 3,888,610 | 6/1975 | Brackman et al. . |
| 3,920,362 | 11/1975 | Bradt . |
| 3,923,444 | 12/1975 | Esper et al. . |
| 3,942,723 | 3/1976 | Langdon . |
| 3,947,537 | 3/1976 | Buntin et al. . |
| 3,954,361 | 5/1976 | Page . |
| 3,970,417 | 7/1976 | Page . |
| 3,978,185 | 8/1976 | Buntin et al. . |
| 3,981,650 | 9/1976 | Page . |
| 4,007,625 | 2/1977 | Houben et al. . |
| 4,015,963 | 4/1977 | Levecque et al. . |
| 4,015,964 | 4/1977 | Levecque et al. . |
| 4,050,866 | 9/1977 | Kilsdonk . |
| 4,052,002 | 10/1977 | Stouffer et al. . |
| 4,052,183 | 10/1977 | Levecque et al. . |
| 4,100,324 | 7/1978 | Anderson et al. . |
| 4,145,173 | 3/1979 | Pelzer et al. . |
| 4,151,955 | 5/1979 | Stouffer . |
| 4,185,981 | 1/1980 | Ohsato et al. . |
| 4,189,455 | 2/1980 | Raganato et al. . |
| 4,277,436 | 7/1981 | Shah et al. . |
| 4,300,876 | 11/1981 | Kane et al. . |
| 4,340,563 | 7/1982 | Appel et al. . |
| 4,359,445 | 11/1982 | Kane et al. . |
| 4,380,570 | 4/1983 | Schwarz . |
| 4,457,685 | 7/1984 | Huang et al. . |
| 4,526,733 | 7/1985 | Lau . |
| 4,596,346 | 6/1986 | Bauer . |
| 4,645,444 | 2/1987 | Lenk et al. . |
| 4,652,225 | 3/1987 | Dehennau et al. . |
| 4,694,992 | 9/1987 | Stouffer . |
| 4,708,619 | 11/1987 | Balk . |
| 4,746,283 | 5/1988 | Hobson . |
| 4,747,986 | 5/1988 | Chao . |
| 4,785,996 | 11/1988 | Ziecker et al. . |
| 4,812,276 | 3/1989 | Chao . |
| 4,818,463 | 4/1989 | Buehning . |
| 4,818,464 | 4/1989 | Lau . |
| 4,826,415 | 5/1989 | Mende . |
| 4,874,451 | 10/1989 | Boger et al. . |
| 4,889,476 | 12/1989 | Buehning . |
| 4,905,909 | 3/1990 | Woods . |
| 4,923,706 | 5/1990 | Binley et al. . |
| 4,949,668 | 8/1990 | Heindel et al. . |
| 4,955,547 | 9/1990 | Woods . |
| 4,983,109 | 1/1991 | Miller et al. . |
| 5,013,232 | 5/1991 | Way . |
| 5,017,116 | 5/1991 | Carter et al. . |
| 5,035,361 | 7/1991 | Stouffer . |
| 5,066,435 | 11/1991 | Lorenz et al. . |
| 5,067,885 | 11/1991 | Stevenson et al. . |
| 5,069,853 | 12/1991 | Miller . |
| 5,094,792 | 3/1992 | Baran . |
| 5,098,636 | 3/1992 | Balk . |
| 5,114,752 | 5/1992 | Hall . |
| 5,129,585 | 7/1992 | Bauer . |
| 5,145,689 | 9/1992 | Allen et al. . |
| 5,165,940 | 11/1992 | Windley . |
| 5,207,970 | 5/1993 | Joseph et al. . |
| 5,260,003 | 11/1993 | Nyssen et al. . |
| 5,269,670 | 12/1993 | Allen et al. . |
| 5,312,500 | 5/1994 | Kurihara et al. . |
| 5,342,647 | 8/1994 | Heindel et al. . |
| 5,354,378 | 10/1994 | Hauser et al. . |
| 5,407,619 | 4/1995 | Maeda et al. . |
| 5,409,733 | 4/1995 | Boger et al. . |
| 5,418,009 | 5/1995 | Raterman et al. . |
| 5,421,921 | 6/1995 | Gill et al. . |
| 5,421,941 | 6/1995 | Allen et al. . |
| 5,423,935 | 6/1995 | Benecke et al. . |
| 5,429,840 | 7/1995 | Raterman et al. . |
| 5,445,509 | 8/1995 | Allen et al. . |
| 5,458,291 | 10/1995 | Brusko et al. . |
| 5,458,721 | 10/1995 | Raterman . |
| 5,476,616 | 12/1995 | Schwarz . |
| 5,478,224 | 12/1995 | McGuffy . |
| 5,503,784 | 4/1996 | Balk . |
| 5,524,828 | 6/1996 | Raterman et al. . |
| 5,540,804 | 7/1996 | Raterman . |
| 5,605,706 | 2/1997 | Allen et al. . |
| 5,618,347 | 4/1997 | Clare et al. . |
| 5,618,566 | 4/1997 | Allen et al. . |
| 5,620,139 | 4/1997 | Ziecker . |
| 5,679,379 | 10/1997 | Fabbricante et al. . |
| 5,902,540 | 5/1999 | Kwok . |
| 5,904,298 | 5/1999 | Kwok . |
| 6,077,375 | 6/2000 | Kwok . |

OMEGA SPRAY PATTERN AND METHOD THEREFOR

CROSS REFERENCE TO RELATED APPLICATIONS

The present application is related to U.S. application Ser. No. 08/843,224 filed on Apr. 14, 1997, entitled "Improved Meltblowing Method and System", now U.S. Pat. No. 5,904,298, and U.S. application Ser. No. 09/060,581 filed on Apr. 15, 1998, entitled "Elastic Strand Coating Process", now U.S. Pat. No. 6,077,375 both assigned commonly and incorporated herein by reference.

BACKGROUND OF THE INVENTION

The invention relates generally to the dispensing of visco-elastic fluidic materials, and more particularly to methods for producing vacillating visco-elastic fibers for application onto substrates and elongated strands, and combinations thereof.

It is desirable in many manufacturing operations to form visco-elastic fibers or filaments, which are deposited onto substrates and elongated strands moving relative thereto. These operations include the application of fiberized adhesives, including temperature and pressure sensitive adhesives, onto substrates and elongated strands for bonding to substrates. Other operations include the application of non-bonding fiberized visco-elastic materials onto various substrates as protective overlays, for example onto sheet-like articles which are stacked or packaged one on top of another, whereby the non-bonding fiberized material provides a protective overlay or separating member between the stacked articles.

One exemplary bonding operation is the application of substantially continuous adhesive fibers onto woven and non-woven fabric substrates for bonding to other substrates and for bonding to overlapping portions of the same substrate in the manufacture of a variety of bodily fluid absorbing hygienic articles. The adhesive fibers may also be applied to elongated elastic strands for bonding to portions of the substrate, for example in the formation of elastic waste and leg band portions of diapers and other undergarments. Another exemplary adhesive fiber bonding operation is the bonding of paper substrates and overlapping portions of the same substrate in the manufacture of paper packaging, for example disposable paper sacks.

In many adhesive fiber bonding operations, including the exemplary bodily fluid absorbing hygienic article and paper packaging manufacturing operations, as well as many non-bonding operations, it is desirable to uniformly apply the visco-elastic fibers onto the substrate and to accurately control where on the substrate the visco-elastic fibers are applied. The uniform application of visco-elastic fibers onto substrates and elongated strands ensures consistent bonding between substrates, or overlapping layer portions thereof, and elongated strands. The uniform application of visco-elastic fibers onto substrates and elongated strands also economizes usage thereof. Accurately controlling where the visco-elastic fibers are applied onto the substrate ensures proper and complete bonding in areas where bonding is desired, provides a distinct interface between areas of bonding and non-bonding, and generally reduces substrate waste resulting from visco-elastic fibers applied uncontrollably to areas thereof outside or beyond the desired target or bonding areas.

In the manufacture of bodily fluid absorbing hygienic articles, it is desirable to provide maximum absorbency and softness of overlapping bonded substrates and at the same time provide effective bonding therebetween. It is also desirable to bond stretched elongated elastic strands relatively continuously along the axial length thereof for bonding onto substrates so that the stretched strands do not slip, or creep, relative to the substrate when the substrate and strand are later severed in subsequent fabrication operations. More generally, it is desirable to accurately and uniformly apply visco-elastic fibers onto substrates and elongated strands, without undesirable overlapping of adjacent fibers, and with well defined, or distinct, interfaces between substrate areas with and without fiber coverage. Similar results are desirable in the application of bonding and non-bonding fibers onto substrates and elongated strands used in operations besides the exemplary manufacture of hygienic articles.

In the past, visco-elastic fibers have been applied onto substrates with melt blowing and spiral nozzles. Conventional melt blowing and spiral nozzles however do not adequately satisfy all of the requirements in the manufacture of bodily fluid absorbing hygienic articles and other operations discussed generally above, or do so to a limited extent using adhesive excessively and inefficiently. Melt blowing nozzles generally dispense fibers chaotically in overlapping patterns, and spiral nozzles dispense fibers in overlapping spiral patterns. The fiber patterns produced by these conventional nozzles tend to stiffen the substrate, which is particularly undesirable in the manufacture of bodily fluid absorbing hygienic articles. The fiber patterns produced by conventional nozzles also tend to reduce the puffiness and hence softness of bonded substrates, or fabrics, which reduces the comfort thereof. Additionally, fiber patterns produced by conventional nozzles tend to reduce the absorbency of fabrics by obstructing the flow of moisture between layers, usually from the inner layers toward more absorbent outer layers. The conventional nozzles also apply fibers onto the substrate relatively non-uniformly, and lack precise control over where the fibers are applied onto substrates and elongated strands.

The present invention is drawn toward advancements in the art of producing visco-elastic fluidic material flows, and more particularly to methods for producing vacillating visco-elastic fibers for application onto substrates and elongated strands, and combinations thereof.

It is an object of the invention to provide novel methods for producing vacillating visco-elastic fluidic material flows for application onto various substrates and elongated strands and combinations thereof that overcome problems in the art.

It is another object of the invention to provide novel methods for producing vacillating visco-elastic fluidic material flows for application onto various substrates and elongated strands and combinations thereof having one or more advantages over the prior art, including relatively improved control over where the fibers are deposited onto substrates and elongated strands, relatively uniform application of the fibers onto substrates and elongated strands, and economizing usage of the fibers and drawing gases associated with the application thereof.

It is another object of the invention to provide novel methods for producing vacillating visco-elastic fibers for application onto various substrates and elongated strands and combinations thereof, especially in the manufacture of bodily fluid absorbing hygienic articles. And it is a related object to provide bodily fluid absorbing hygienic articles having well bonded woven and/or non-woven substrates with improved absorbency and softness.

It is a more particular object of the invention to provide novel methods for producing visco-elastic fluidic material flows comprising generally drawing a visco-elastic fluidic material with corresponding separate second fluid flows associated therewith to form a visco-elastic fiber vacillating in a repeating, generally omega-shaped pattern having a bowed portion with first and second side portions that first converge toward each other and then diverge outwardly in generally opposing directions.

It is another more particular object of the invention to provide novel methods for producing visco-elastic fluidic material flows comprising generally drawing a visco-elastic fluidic material with corresponding separate second fluid flows associated therewith to form a visco-elastic fiber vacillating in a repeating, generally omega-shaped pattern, and depositing the vacillating visco-elastic fiber onto substrates and/or elongated strands moving relative thereto, and combinations thereof. It is a related object of the invention to deposit the vacillating visco-elastic fiber onto one or more stretched elongated elastic strands disposed on a substrate for adhering, or stitching, the stretched elongated elastic strands to the substrate substantially continuously along the axial length thereof.

These and other objects, aspects, features and advantages of the present invention will become more fully apparent upon careful consideration of the following Detailed Description of the Invention and the accompanying Drawings, which may be disproportionate for ease of understanding, wherein like structure and steps are referenced generally by corresponding numerals and indicators.

DETAILED DESCRIPTION OF THE INVENTION

Figure 1:
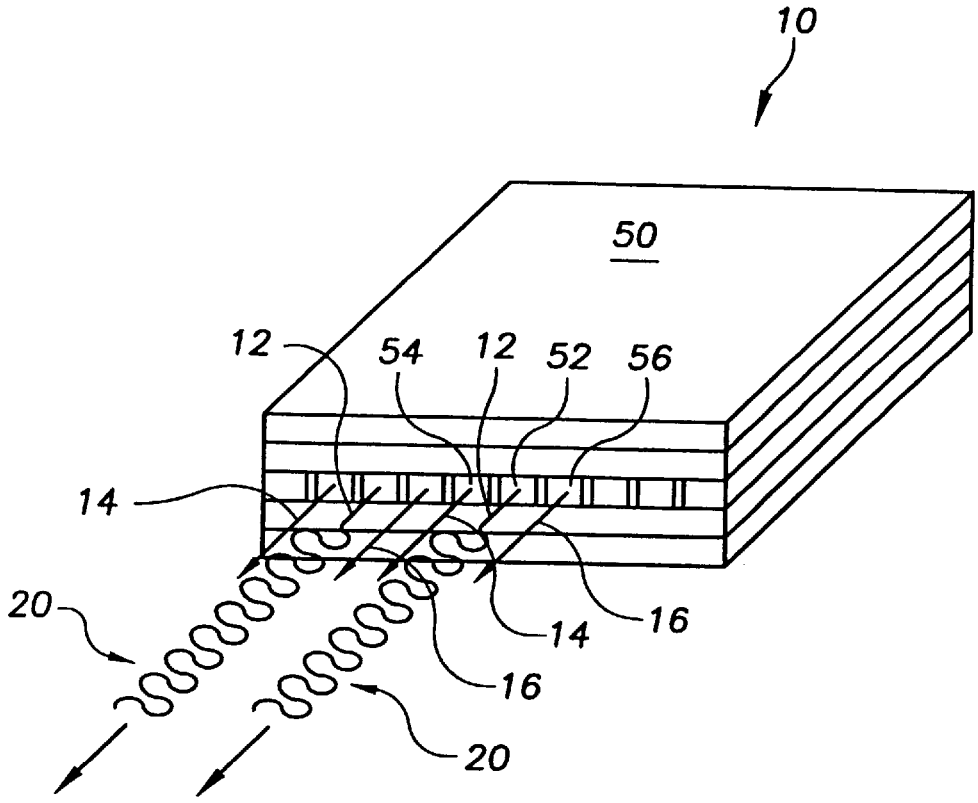
FIG. 1 is an apparatus for producing a visco-elastic fiber vacillating in a repeating, generally omega-shaped pattern according to the present invention.

FIG. 1 is an apparatus 10 for producing one or more visco-elastic fluidic material flows, or fibers, 20, which may be deposited onto substrates or elongate strands and which are useable in various bonding and non-bonding operations. The visco-elastic fluidic material is, for example, a polyethylene or polypropolene or other polymer formulated for bonding and/or non-bonding applications. These visco-elastic materials however are exemplary only, and are not intended to be limiting since any visco-elastic fluidic material that may be drawn into relatively continuous fibers or filaments are suitable for practicing the present invention.

In one exemplary operation, the visco-elastic fluidic material is a temperature or pressure sensitive adhesive useable for bonding overlapping substrates. These operations include, for example, applying adhesive fibers onto woven and non-woven substrates in the manufacture of bodily fluid absorbing hygienic articles, and onto paper substrates in the manufacture of paper packaging materials, and onto various other substrates, which are bonded with other substrates or with elongated strands. In another exemplary application, the visco-elastic fluidic material is a non-adhesive material deposited onto other substrates in non-bonding operations, for example as protective overlays between substrates, like glass and other materials.

Figure 2:
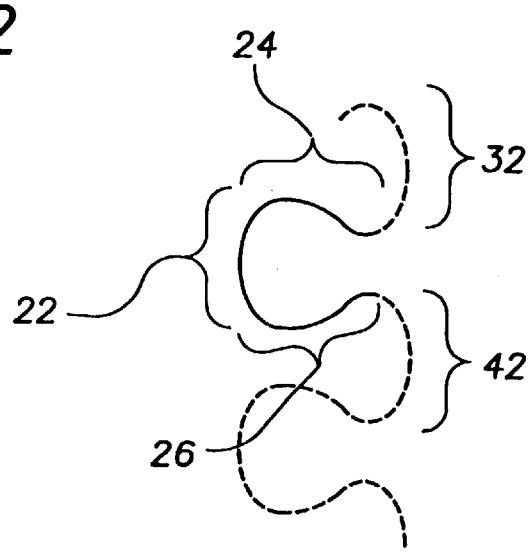
FIG. 2 is a partial view of the repeating, generally omega-shaped visco-elastic fiber pattern.

FIG. 1 illustrates the nozzle 10 producing a visco-elastic fiber 20 in a repeating, generally omega-shaped pattern. FIG. 2 illustrates a segment of the repeating, generally omega-shaped pattern having a bowed portion 22 with first and second side portions 24 and 26 each shared with corresponding adjacent bowed portions 32 and 42 of adjacent segments of the pattern, which are illustrated in phantom lines. The first and second side portions 24 and 26 first converge toward each other and then diverge outwardly in generally opposing directions before merging with the corresponding adjacent bowed portions 32 and 42. According to the present invention, the repeating, generally omega-shaped pattern of the fibers 20 are produced remarkably consistently and uniformly, and are particularly well suited for many bonding and non-bonding operations with significant advantages over conventional overlapping chaotic and spiral fiber patterns produced by conventional nozzles.

In FIG. 1, the repeating, generally omega-shaped pattern of the visco-elastic fiber 20 is produced generally by dispensing a visco-elastic fluidic material to form a first fluid flow 12 at a first velocity, and dispensing a second fluid to form separate second fluid flows 14 and 16 at a second velocity along generally opposing flanking sides of the first fluid flow 12. The separate second fluid flows 14 and 16 are located and oriented relative to the first fluid flow 12 to vacillate the first fluid flow 12 in a manner that produces the repeating, generally omega-shaped pattern.

The second fluid flows 14 and 16, which are preferably a gas like air, are spaced from the first fluid flow 12 and dispensed at a second velocity greater than a first velocity of the first fluid flow 12 so that the first fluid flow 12 is drawn by the separate second fluid flows and vacillated to form the visco-elastic fiber in the repeating, generally omega-shaped pattern 20 illustrated in FIGS. 1 and 2. The first fluid flow 12 and the separate second fluid flows 14 and 16 are preferably dispensed in a common plane, whereby the first fluid flow is vacillated to form the repeating generally omega-shaped pattern in the common plane containing the first and separate second fluid flows, illustrated best in FIG. 1. In one mode of operation, the separate second fluid flows 14 and 16 are converged toward the first fluid flow 12 to form the fiber in the repeating, generally omega-shaped pattern 20. And in another alternative mode of operation, the separate second fluid flows 14 and 16 are dispensed parallel to the first fluid flow 12 to form the fiber in the repeating, generally omega-shaped pattern 20.

Generally, as the second velocity of the separate second fluids flows 14 and 16 increases relative to the first velocity of the first fluid flow 12, the first fluid flow 12 is correspondingly drawn increasingly and begins to vacillate back and forth with correspondingly increasing amplitude and frequency, as disclosed generally and more fully in copending U.S. application Ser. No. 08/843,224 filed on Apr. 14, 1997, entitled "Improved Meltblowing Method and System", now U.S. Pat. No. 5,904,298, incorporated herein by reference. As the second velocity of the separate second fluid flows 14 and 16 increases further relative to the first velocity of the first fluid flow 12, the first fluid flow 12 begins to vacillate in the desired repeating, generally omega-shaped pattern 20. Further increases in the second velocity of the separate second fluid flows 14 and 16 relative to the first velocity of the first fluid flow 12 eventually results in a generally chaotic vacillation of the visco-elastic fiber, which may be desirable for some operations but is beyond the scope of the present application.

FIG. 1 illustrates the visco-elastic fluidic material dispensed from a first orifice 52 in a body member 50, or die assembly, to form the first fluid flow 12, and the second fluid dispensed from two second orifices 54 and 56 in the body member 50 associated with the first orifice 52. The two second orifices 54 and 56 are disposed on generally opposing flanking sides of the first orifice 52, in a common plane, to form the separate second fluid flows 14 and 16 along generally opposing flanking sides of the first fluid flow 12. The body member 50 is preferably a parallel plate body member as disclosed generally and more fully in the copending U.S. application Ser. No. 08/843,224 filed on Apr. 14, 1997, now U.S. Pat. No. 5,904,298, entitled "Improved Meltblowing Method and System" incorporated herein by reference.

In one exemplary adhesive dispensing operation suitable for the manufacture of bodily fluid absorbing hygienic articles, the orifices of the parallel plate die assembly are generally rectangular. More particularly, the adhesive orifices are approximately 0.022 inches by approximately 0.030 inches and the corresponding separate air orifices are approximately 0.033 inches by approximately 0.030 inches. In the exemplary adhesive dispensing operation, the adhesive mass flow rate is approximately 10 grams per minute per adhesive orifice, and the air mass flow rate is approximately 0.114 cubic feet per minute for the two corresponding air orifices. Under these exemplary operating conditions, a repeating, generally omega-shaped pattern having a width, or amplitude, of approximate 0.25 inches is produced when the air pressure is between approximately 3 pounds per square inch (psi) and approximately 10 psi, with a preferable operating air pressure of approximately 6 psi. The air temperature is generally the same as or greater than the adhesive temperature, and may be adjusted to control the adhesive temperature, which is usually specified by the manufacturer.

These exemplary die orifice specifications are not intended to be limiting, and may be varied considerably to produce the repeating, generally omega-shaped pattern. The orifices may be formed in more conventional non-parallel plate die assemblies, and may be circular rather than rectangular. The air and adhesive mass flow rates, as well as the air pressure required to produce the repeating, generally omega-shaped pattern may also be varied outside the exemplary ranges. For example, the width of the amplitude and weight of the repeating, generally omega-shaped patterns 20 may be varied by appropriately selecting the air and adhesive orifice sizes and the controlling the air and adhesive mass flow rates. For many adhesive dispensing operations the amplitude of the repeating, generally omega-shaped pattern is generally between approximately 0.125 and 1 inches, but may be more or less.

A body member 50, or die assembly, configured and operated as discussed above produces remarkably uniform and consistent repeating, generally omega-shaped pattern 20. Additionally, the amplitude and frequency of the repeating, generally omega-shaped patterns 20 may be controlled relatively precisely as discussed above and more fully in the copending U.S. application Ser. No. 08/843,224 filed on Apr. 14, 1997, entitled "Improved Meltblowing Method and System", now U.S. Pat. No. 5,904,298, incorporated herein by reference. Thus the repeating, generally omega-shaped pattern may be deposited onto a substrate or elongated strand with substantial uniformity and accuracy not heretofore available with conventional fiber or filament dispensing nozzles.

Figure 3:
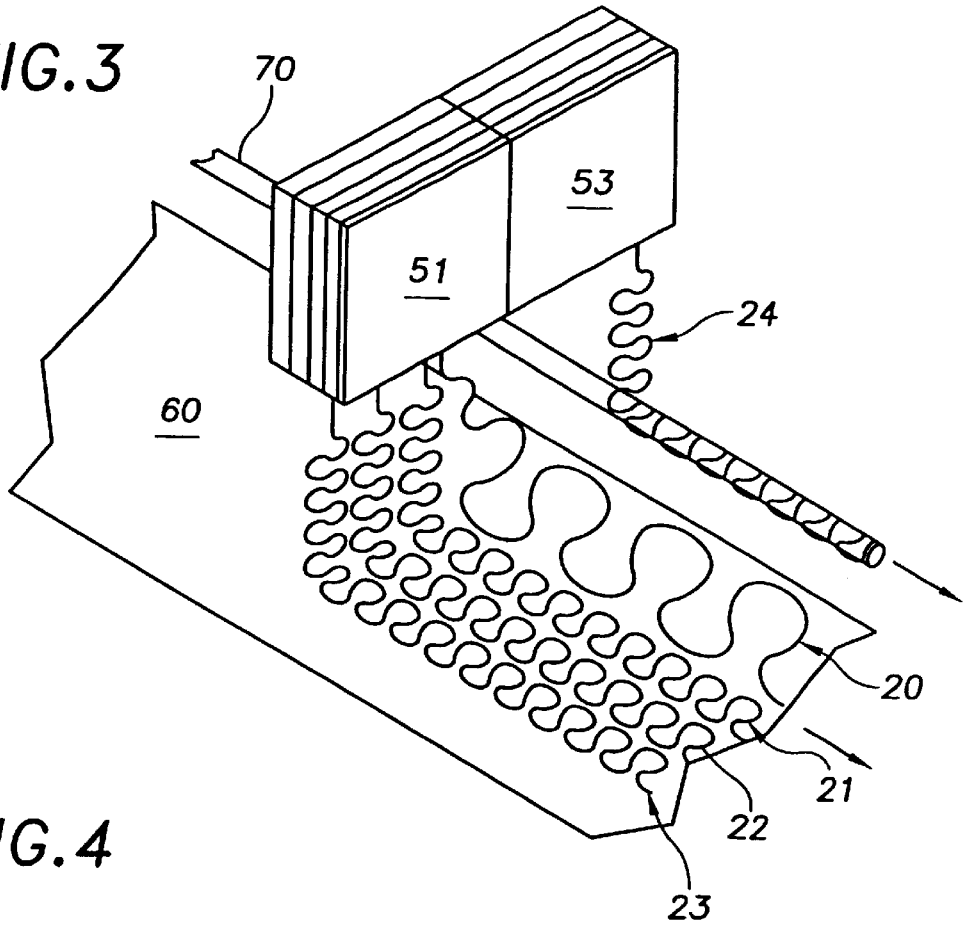
FIG. 3 is an exemplary application of visco-elastic fibers vacillating in repeating, generally omega-shaped patterns onto a substrate and an elongated strand.

FIG. 3 illustrates a first parallel plate die assembly 51 having nozzles for depositing multiple repeating, generally omega-shaped patterns 20 with differing amplitudes onto a substrate 60 moving relative thereto in a substrate coating operation. An alternative and equivalent is for the die assembly 51 to move relative to a fixed substrate. In the exemplary embodiment, the first fluid flows forming the repeating, generally omega-shaped patterns 20 are vacillated non-parallel to the movement direction of the substrate by the corresponding second fluid flows, and more particularly the first fluid flows are vacillated transversely to the movement direction of the substrate 60. This aspect of the invention is disclosed more fully in the copending U.S. application Ser. No. 08/843,224 filed on Apr. 14, 1997, entitled "Improved Meltblowing Method and System", now U.S. Pat. No. 5,904,298, incorporated herein by reference.

According to the present invention, the repeating, generally omega-shaped patterns 20 may be deposited relatively continuously onto a surface of the substrate in single or multiple parallel patterns, which selectively cover the substrate as desired for the particular application. In FIG. 3 for example, two or more repeating, generally omega-shaped patterns 21, 22 and 23 may be applied to the substrate 60 side-by-side providing relatively complete substrate coverage without undesirable overlapping therebetween. And in operations where some overlapping of adjacent fiber patterns 20 is desired, the extent of the overlap can be controlled relatively precisely in the practice of the present invention. This is due in part to the relatively consistent width of the fibers 20 produced, and also to the location accuracy with which the fibers 20 are applied onto the substrate.

Figure 4:
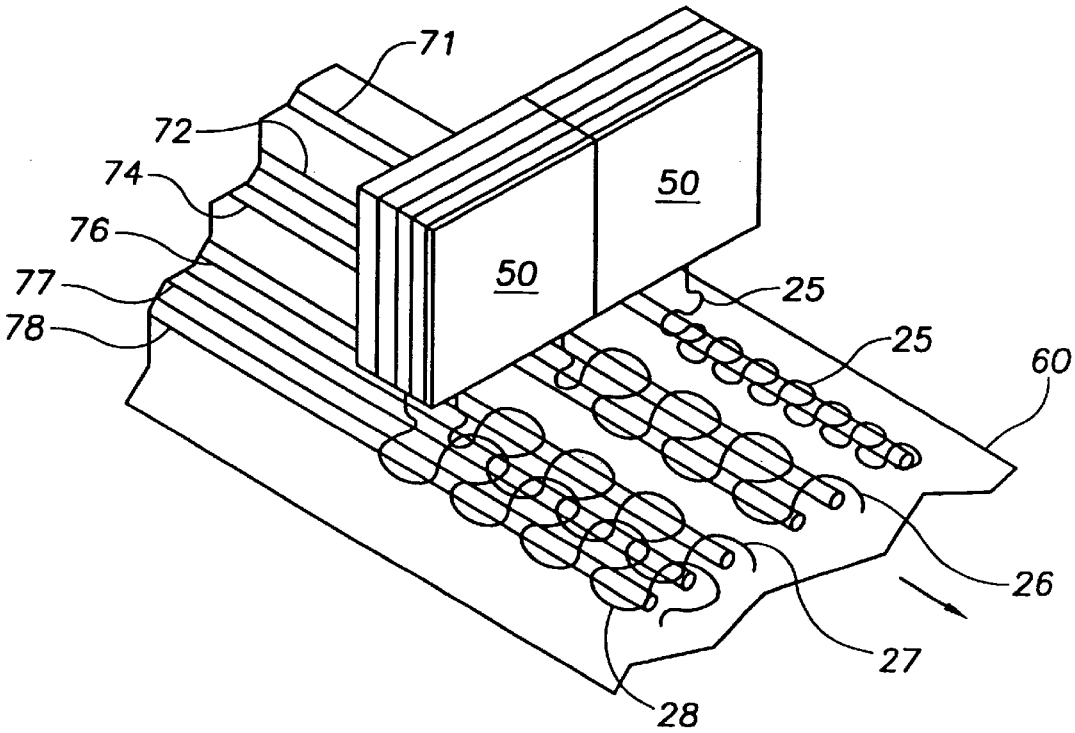
FIG. 4 is another exemplary application of visco-elastic fibers vacillating in repeating, generally omega-shaped patterns onto substrates and elongated strands.

FIGS. 3 and 4 illustrate also how the repeating, generally omega-shaped fiber patterns 20 provide excellent bonding without compromising absorbency and softness of the substrate, which is so desirable when bonding woven and non-woven fabric substrates in the manufacture of bodily fluid absorbing hygienic articles. More particularly, the repeating, generally omega-shaped fiber patterns 20 provide uniform substrate coverage with substantial adhesive bonding area, yet fiber overlapping is eliminated or at least reduced substantially where undesired. Thus the tendency of the fabric to stiffen due to globular and overlapping fibers is eliminated. The repeating, generally omega-shaped fiber patterns 20 also provide relatively large areas of adhesive non-coverage through which bodily fluids may flow unobstructed. These large areas of adhesive non-coverage also reduce the tendency of the woven and non-woven fabric substrates to flatten and lose puffiness, which otherwise occurs with fibers produced by conventional nozzles, thereby increasing the softness of the bonded substrates.

FIG. 3 also illustrates a second parallel plate die assembly 53 depositing a repeating, generally omega-shaped fiber pattern 24 onto at least one isolated elongated strand 70 moving relative thereto in a strand coating operation. An alternative and equivalent is for the die assembly 53 to move relative to a fixed strand. According to the strand coating operation, the repeating, generally omega-shaped pattern is vacillated generally non-parallel, and in the exemplary operation transversely to, a direction of movement of the isolated elongated strand 70. The uniformity and consistency of the repeating, generally omega-shaped pattern ensures relatively uniform application thereof along the axial dimension of the elongated strand, which is particularly desirable in operations where the strand is a stretched elongated elastic strand subsequently bonded to some other substrate, thereby reducing the tendency of the bonded elongated strand 70 to thereafter creep relative to the substrate 60 when severed during subsequent fabrication operations. More generally, at least one repeating, generally omega-shaped fiber pattern may be deposited onto two or more isolated elongated strands moving relative thereto in a strand coating operation. Alternatively, multiple adjacent or overlapping repeating, generally omega-shaped fiber patterns may be deposited onto two or more isolated elongated strands moving relative thereto in a strand coating operation.

In one operation, the amplitude or width of the repeating, generally omega-shaped pattern 24 is selected so that substantially all of the visco-elastic material vacillating in the repeating, generally omega-shaped pattern is captured on or about an isolated elongated strand 70 as disclosed generally and more fully in the copending U.S. application Ser. No. 09/060,581 filed on Apr. 15, 1998, entitled "Elastic Strand Coating Process", now U.S. Pat. No. 6,077,375, incorporated herein by reference. The uniform width of the repeating, generally omega-shaped pattern 24 and the accuracy with which it is deposited makes possible the capture of substantially all of the fiber 24 onto the elongated strand 70, which is highly desirable in manufacturing operations and is a significant advantage over conventional elongated strand bonding operations.

FIG. 4 illustrates another alternative operation wherein a repeating, generally omega-shaped fiber pattern 25 is deposited onto at least one corresponding elongated strand 71, which may be a stretched elongated elastic strand, disposed either directly on the substrate 60, or raised thereabove. The uniformity and consistency of the repeating, generally omega-shaped pattern ensures relatively uniform application thereof along the axial dimension of the at least one elongated strand 71. Also, the amplitude or width of the repeating, generally omega-shaped pattern 25 may be selected so that the repeating, generally omega-shaped fiber pattern just covers the elongated strand 71 widthwise, for example in a bonding operation whereby the fiber is an adhesive material, so that the elongated strand 71 is effectively stitched to the substrate 60.

In another operation, a single repeating, generally omega-shaped pattern 26 may be deposited onto two or more elongated strands 72 and 74 disposed either directly on the substrate 60, or raised thereabove. And in other operations, two or more repeating, generally omega-shaped patterns 27 and 28 may be deposited, either adjacently or overlappingly, as illustrated, onto multiple elongated strands 76, 77 and 78 disposed either directly on the substrate 60, or raised thereabove. The width and weight of the repeating, generally omega-shaped fiber patterns, and the location of deposition thereof onto the strand and/or substrate of course, depends on the configuration of the die assembly 50 as discussed hereinabove.

While the foregoing written description of the invention enables one of ordinary skill to make and use what is considered presently to be the best mode thereof, those of ordinary skill will understand and appreciate the existence of variations, combinations, and equivalents of the specific exemplary embodiments herein. The invention is therefore to be limited not by the exemplary embodiments herein, but by all embodiments within the scope and spirit of the appended claims.

What is claimed is:

1. A method for producing a visco-elastic fluidic material flow comprising:

dispensing the visco-elastic fluidic material to form a first fluid flow at a first velocity;

dispensing a second fluid to form separate second fluid flows at a second velocity along generally opposing flanking sides of the first fluid flow; and vacillating the first fluid flow with the separate second fluid flows to form a repeating generally omega-shaped pattern, the generally omega-shaped pattern having a bowed portion with first and second side portions, the first and second side portions converging toward each other and then diverging outwardly in generally opposing directions.

2. The method of claim 1 further comprising drawing the first fluid flow with the separate second fluid flows at the second velocity greater than the first velocity of the first fluid flow to form a visco-elastic fiber vacillating in the repeating generally omega-shaped pattern, the separate second fluid flows are air flows.

3. The method of claim 1 further comprising dispensing the first fluid flow and the separate second fluid flows in a common plane, and vacillating the first fluid flow to form the repeating generally omega-shaped pattern in the common plane containing the first and separate second fluid flows.

4. The method of claim 1 further comprising converging the separate second fluid flows toward the first fluid flow to vacillate the first fluid flow and form the repeating generally omega-shaped pattern.

5. The method of claim 1 further comprising dispensing the separate second fluid flows parallel to the first fluid flow to vacillate the first fluid flow and form the repeating generally omega-shaped pattern.

6. The method of claim 1 further comprising dispensing the visco-elastic fluidic material from a first orifice in a body member to form the first fluid flow, and dispensing the second fluid from two second orifices in the body member associated with the first orifice, the two second orifices disposed on generally opposing flanking sides of the first orifice to form the separate second fluid flows along generally opposing flanking sides of the first fluid flow.

7. The method of claim 1 further comprising dispensing the visco-elastic fluidic material from a first orifice in a parallel plate body member to form the first fluid flow, and dispensing the second fluid from two second orifices in the parallel plate body member associated with the first orifice, the two second orifices disposed on generally opposing flanking sides of the first orifice to form the separate second fluid flows along generally opposing flanking sides of the first fluid flow.

8. The method of claim 1 further comprising depositing the repeating generally omega-shaped pattern of the vacillating first fluid flow onto a substrate moving relative thereto.

9. The method of claim 1 further comprising depositing the repeating generally omega-shaped pattern of the vacillating first fluid flow onto at least one elongated strand moving relative thereto.

10. The method of claim 9 further comprising depositing the repeating generally omega-shaped pattern of the vacillating first fluid flow onto at least one stretched elongated elastic strand disposed on a substrate.

11. The method of claim 9 further comprising vacillating the first fluid flow non-parallel to a direction of movement of at least one isolated elongated strand, and capturing substantially all of the visco-elastic fluidic material on the at least one isolated elongated strand.

12. The method of claim 9 further comprising depositing at least one repeating generally omega-shaped pattern of the vacillating first fluid flow onto at least two isolated elongated strands.

13. The method of claim 1 further comprising:

dispensing the visco-elastic fluidic material to form a plurality of first fluid flows at a first velocity;

dispensing the second fluid to form a plurality of second fluid flows at a second velocity, the plurality of first fluid flows and the plurality of second fluid flows arranged in a series so that each of the plurality of first fluid flows is flanked on substantially opposing sides by corresponding second fluid flows associated therewith;

vacillating the plurality of first fluid flows with the separate second fluid flows so that each first fluid flow forms a repeating generally omega-shaped pattern.

14. The method of claim 13 further comprising drawing each of the plurality of first fluid flows with two corresponding second fluid flows at a second velocity greater than a first velocity of the first fluid flow to form a visco-elastic fiber vacillated to form the repeating generally omega-shaped pattern.

15. The method of claim 13 further comprising converging the second fluid flows on opposing flanking sides of a corresponding first fluid flow toward the corresponding first fluid flow to vacillate the first fluid flow and form the repeating generally omega-shaped pattern.

16. The method of claim 13 further comprising dispensing the visco-elastic fluidic material from a plurality of first orifices in a body member to form the plurality of first fluid flows, and dispensing the second fluid from a plurality of second orifices in the body member to form the plurality of second fluid flows along generally opposing flanking sides of the plurality of first fluid flows.

17. A method for depositing a viscoelastic filament comprising:

forming a filament adjacent a moving elongated member;

vacillating the filament in a repeating generally omega-shape pattern, the generally omega-shape pattern having a bowed portion with first and second side portions that first converge and then diverge away from each other; and capturing the vacillating filament on the elongated member.

18. The method of claim 17, the elongated member is a strand, capturing substantially all of the vacillating filament on the strand.

19. The method of claim 17, vacillating the filament predominately non-parallel to a direction of the moving elongated member.

20. The method of claim 17, forming the filament by drawing a first fluid flow with two separate second fluid flows directed along substantially opposing sides thereof.

21. The method of claim 20, vacillating the filament predominately between the two separate second fluid flows directed along substantially opposing sides of the filament.

22. The method of claim 21, forming the first fluid flow by dispensing a first fluid from a first orifice in a body member, forming the two second fluid flows by dispensing a second fluid from corresponding separate second orifices disposed in the body member on substantially opposing sides of the first orifice.

23. The method of claim 22, vacillating the filament predominately transversely to the direction of the elongated member.

24. The method of claim 17, the moving elongated member is a strand, capturing the vacillating filament on the strand.

25. The method of claim 24, the moving elongated member is a strand spatially separated from a substrate, capturing substantially all of the filament on the strand when the strand is separated from the substrate, and adhering the filament coated strand to the substrate.

26. A method for depositing a viscoelastic filament comprising:

forming a filament adjacent a moving substrate;

vacillating the filament in a repeating generally omega-shape pattern, the generally omega-shape pattern having a bowed portion with first and second side portions that first converge and then diverge away from each other; and depositing the vacillating filament onto the substrate.

27. The method of claim 26, vacillating the filament predominately non-parallel to a direction of the moving substrate.

28. The method of claim 26, forming the filament by drawing a first fluid flow with two separate second fluid flows directed along substantially opposing sides thereof.

29. The method of claim 28, vacillating the filament predominately between two separate second fluid flows directed along substantially opposing sides of the filament.

30. The method of claim 29, forming the first fluid flow by dispensing a first fluid from a first orifice in a body member, forming the two second fluid flows by dispensing a second fluid from corresponding separate second orifices disposed in the body member on substantially opposing sides of the first orifice.

31. The method of claim 30, vacillating the filament predominately transversely to the direction of the moving substrate.

32. A method for depositing a viscoelastic filament comprising:

forming a filament by drawing a first fluid flow with two separate second fluid flows directed along substantially opposing sides of the first fluid flow;

vacillating the filament predominately between the two second fluid flows in a repeating generally omega-shape pattern, the generally omega-shape pattern having a bowed portion with first and second side portions converging toward and then diverging away from each other.

33. The method of claim 32, depositing the vacillating filament onto a strand moving non-parallel to a predominant vacillation direction of the filament.

34. The method of claim 32, depositing the vacillating filament onto a substrate moving non-parallel to a predominant vacillation direction of the filament.

35. The method of claim 32, forming the first fluid flow with a first fluid dispensed from a first orifice in a body member, and forming the two second fluid flows with a second fluid dispensed from corresponding separate second orifices disposed in the body member on substantially opposing sides of the first orifice.

36. The method of claim 32, convergently directing the second fluid flows toward the first fluid flow.

37. The method of claim 32, forming a plurality of filaments by drawing a plurality of first fluid flows with two separate corresponding second fluid flows directed along substantially opposing sides of each first fluid flow;

vacillating each of the plurality of filaments predominately between the corresponding second fluid flows in a repeating generally omega-shape pattern.

38. The method of claim 37, depositing the plurality of vacillating filaments onto a substrate moving non-parallel to a predominant vacillation direction of the plurality of filaments.

39. The method of depositing claim 37, forming the plurality of first fluid flows by dispensing the first fluid first from a corresponding plurality of orifices in a body member, forming the plurality of second fluid flows by dispensing a second fluid from a corresponding plurality of second orifices in the body member, each of the plurality of first orifices flanked on substantially opposing sides by two separate second orifices, the plurality of first fluid orifices and plurality of second fluid orifices disposed non-parallel to a direction of the moving substrate.

* * * * *